US005176303A

United States Patent [19]

Franke

[11] Patent Number: 5,176,303

[45] Date of Patent: Jan. 5, 1993

[54] BACK PACK WITH FUEL TANK

[75] Inventor: Jeffery S. Franke, Charlotte, N.C.

[73] Assignee: Textron Inc., Providence, R.I.

[21] Appl. No.: 693,455

[22] Filed: Apr. 29, 1991

[51] Int. Cl.[5] ..... A45F 3/08

[52] U.S. Cl. ..... 224/261; 224/148; 224/270; 224/907; 239/152

[58] Field of Search ..... 224/148, 209, 210, 211, 224/212, 215, 259, 260, 261, 262, 264, 270, 907; 123/510, 514; 417/234; 239/152, 153

[56] References Cited

U.S. PATENT DOCUMENTS

| | | | |
|---|---|---|---|
| 1,981,076 | 11/1934 | Sells | 224/262 |
| 2,519,936 | 8/1950 | Sayre | 224/261 |
| 2,520,559 | 8/1950 | Osius | 417/234 |
| 2,792,670 | 5/1957 | Haynes | 47/1.01 |
| 3,165,774 | 1/1965 | Barba | 15/323 |
| 3,199,785 | 8/1965 | Schmierer | 224/148 X |
| 3,219,129 | 11/1965 | Yamada | 173/30 |
| 3,331,090 | 7/1967 | Reiber et al. | 15/321 |
| 4,290,165 | 9/1981 | Hiramatsu et al. | 15/330 |
| 4,483,070 | 11/1984 | Junkermann | 30/296.1 |
| 4,572,414 | 2/1986 | Blatt | 224/212 |
| 4,644,654 | 2/1987 | Howe et al. | 30/296.1 |
| 4,651,903 | 3/1987 | Paglisi | 222/175 |
| 4,658,778 | 4/1987 | Gamoh et al. | 123/195 C |
| 4,662,551 | 5/1987 | Dudley et al. | 224/211 |
| 4,748,712 | 6/1988 | DiGiovanni | 15/327.5 |
| 4,838,307 | 6/1989 | Sasaki et al. | 123/514 X |
| 4,989,572 | 2/1991 | Giacomazzi et al. | 123/514 |

OTHER PUBLICATIONS

McCulloch, Super Air Stream V Back Pack Gas Blower Makes A Clean Sweep of Yard Work., 1987, two pages.

McCulloch Corporation, User Manual, Super Air Stream V and Eager Beaver Gas-Powered Back-Pack Blower, 16 pages, 1987.

*Primary Examiner*—Henry J. Recla
*Assistant Examiner*—Glenn T. Barrett
*Attorney, Agent, or Firm*—Perman & Green

[57] ABSTRACT

A back pack for carrying a gas operated blower. The back pack has a frame and straps for supporting the frame on the back of an operator. The frame has a dual wall construction forming an internal fuel storage tank. Thus, the blower does not need a separate fuel tank. This reduces the weight and cost of the back pack and blower.

15 Claims, 3 Drawing Sheets

BACK PACK WITH FUEL TANK

BACKGROUND OF THE INVENTION

1. Field of the Invention

The present invention relates to back packs and, more particularly, to a back pack for carrying a machine and for supplying fluid to the machine.

2. Prior Art

There are various different types of back packs in the prior art. U.S. Pat. No. 2,519,936 to Sayer discloses a portable power tool with a supporting structure which is hollow and comprises an air intake passage for transporting cooling air to the engine. A fuel tank is shown connected to the supporting structure. U.S. Pat. No. 4,658,778 to Gamoh et al. discloses a fuel tank arranged on a horizontal frame portion of the frame. U.S. Pat. No. 4,651,903 to Paglisi discloses a motorized pump pressurized liquid sprayer with a container connected to frame. U.S. Pat. No. 2,792,670 to Haynes discloses a tank that may be filled with liquid poison.

In the area of back pack carried leaf blowers there is a constant attempt to reduce the weight of the blower unit and back pack in order to lighten the load carried by the user. In the past the blower units were provided as separately detachable and operable units from their back pack. However, in some situations, such as for lawn, yard, and grounds care professionals back pack leaf blowers are always operated while connected to the back pack frame. Thus, there is no need to provide a blower unit as a separable independently operable blower unit from its back pack frame as done in the past.

Another problem with back pack leaf blowers in the past is that, due to their compact nature, they are usually only provided with relatively small fuel tanks. This necessitates the user having to relatively frequently stop and refill the blower's gas tank.

It is an objective of the present invention to provide a back pack capable of storing a supply of fluid, such as gasoline, for use with a machine carried by the back pack. The frame of the back pack is preferably comprised of a dual wall construction such that the frame has the storage area integrally formed therewith.

SUMMARY OF THE INVENTION

The foregoing problems are overcome and other advantages are provided by a new and improved back pack frame adapted to contain a supply of fluid for a machine or tool to be carried thereon.

In accordance with one embodiment of the present invention, a back pack for use in carrying a machine having an internal combustion engine is provided. The back pack has a frame and straps for removably supporting the back pack and machine on an operator. The frame comprises a first section, and a second section. The first section is adapted to be positioned against a back of an operator. The second section extends generally perpendicularly from the first section and is adapted to have the machine mounted thereon. The second section has an internal storage area therein for supplying fuel to the engine.

In accordance with another embodiment of the present invention, a blower is provided comprising a blower unit, a back pack frame, and means for supplying fuel. The blower unit has an internal combustion engine. The back pack frame is provided for supporting the blower unit on the back of an operator. The frame is comprised of a molded dual wall construction with a vertical section adapted to be supported against the back of an operator and a horizontal section adapted to support the engine thereon. The frame forms an internal fuel storage tank within its dual wall structure. The means for supplying fuel can supply the fuel from the tank to the engine.

In accordance with another embodiment of the present invention, a back pack frame is provided comprising a vertical section, a horizontal section, and means for storing a combustible fuel. The vertical section is adapted to be supported on a back of an operator. The horizontal section is adapted to at least partially support a machine having an internal combustion engine thereon. The means for storing a combustible fuel can store the fuel inside the frame. The means for storing comprises the frame having a molded dual wall construction with a space between portions of the walls such that the space between the walls can function as a fuel tank to store fuel for use with the engine being carried on the frame.

In accordance with another embodiment of the present invention, a back pack frame for use in supporting a machine on the back of an operator is provided. The back pack frame is comprised of molded thermoplastic material having a multiwall construction. The improvement comprises a fuel storage tank and nozzle integrally formed by walls of the frame. The tank and nozzle are adapted to receive and hold fuel intended to be supplied to the machine being carried on the frame.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
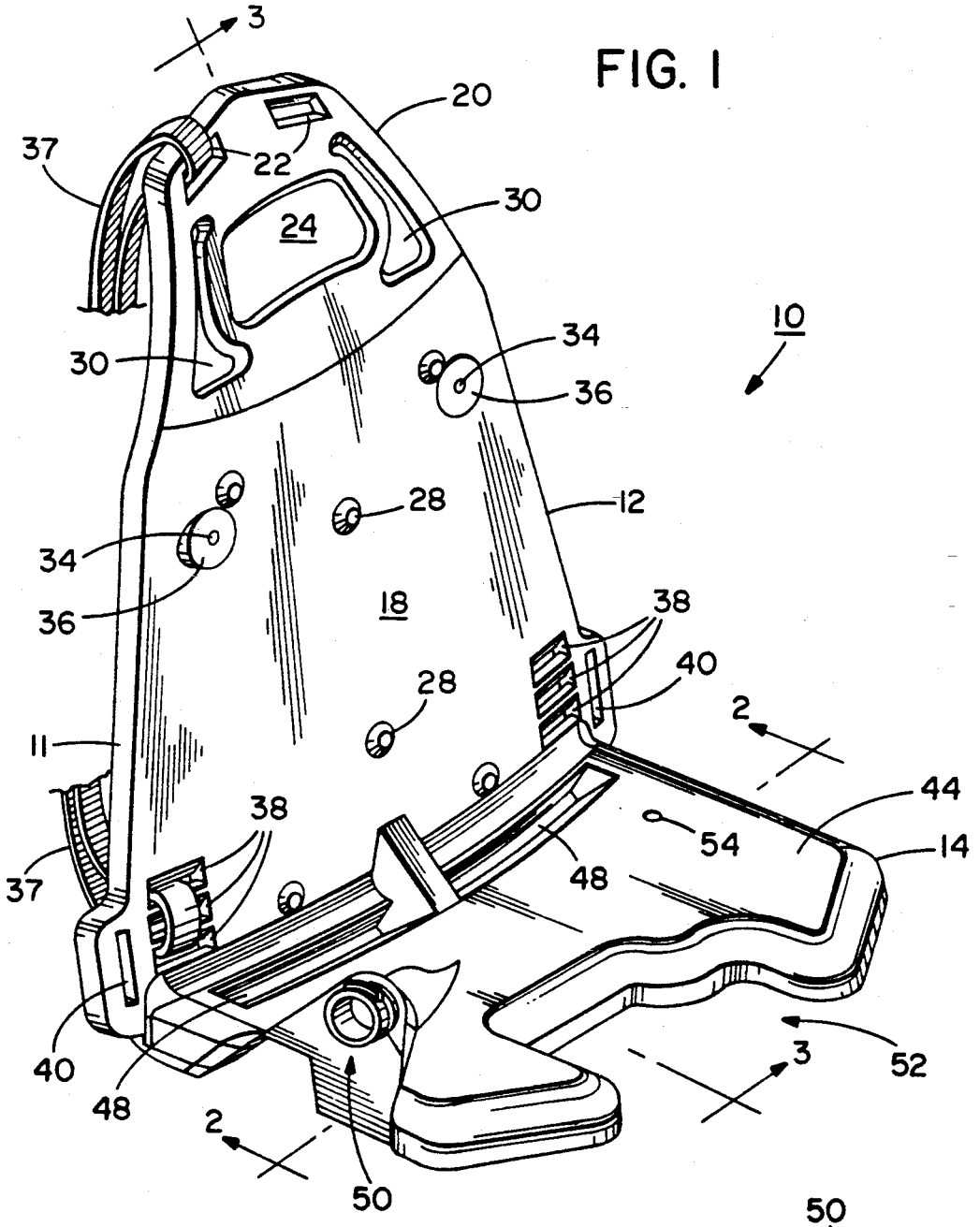
FIG. 1 is a perspective view of a back pack frame incorporating features of the present invention.

Referring to FIG. 1, there is shown a perspective view of a back pack frame 10 incorporating features of the present invention. The frame 10, in the embodiment shown, is generally intended to carry a blower unit (not shown) on a person's back. It should be understood that, although the present invention is being described with reference to use with a blower unit, the present invention can be used with any suitable machine or tool intended to be carried on the back of an operator that requires the supply of fuel or another fluid to the machine. It should also be understood that the present invention may include any suitable size, shape, or type of materials or elements without departing from the spirit of the invention. A further description of a blower unit and another back pack frame intended to carry a blower unit can be found in copending U.S. patent application Ser. No. 07/472,653 filed Jan. 30, 1990 entitled "Leaf Blower Back Pack Frame" by Sapp et al., now U.S. Pat. No. 5,011,058, assigned to the same assignee as herein, which is hereby incorporated by reference in its entirety.

Figure 2:
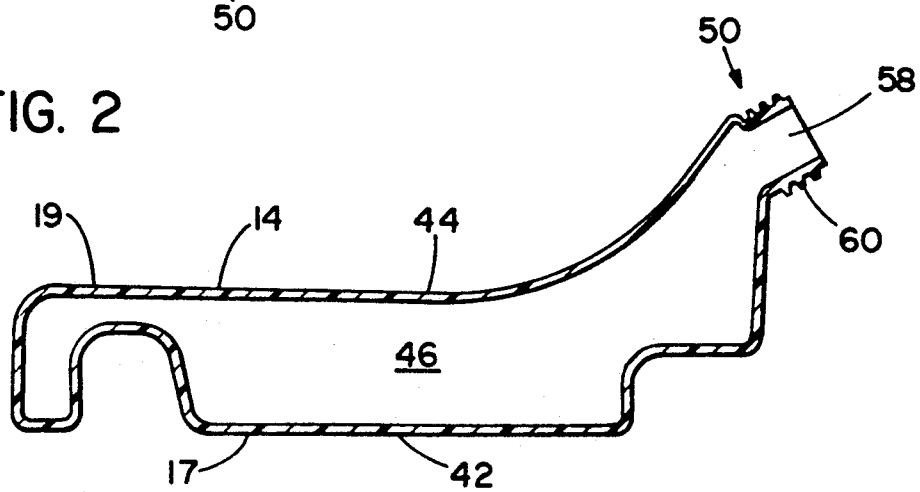
FIG. 2 is a cross sectional view of the frame shown in FIG. 1 taken along line 2—2.
Figure 3:
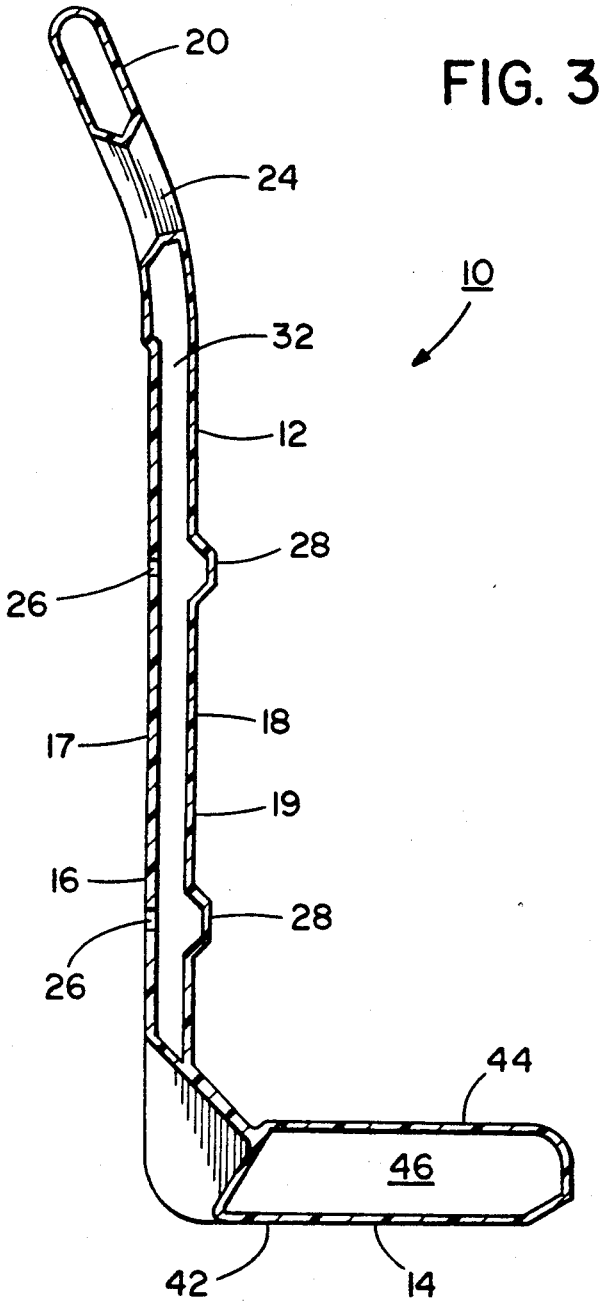
FIG. 3 is a cross sectional view of the frame shown in FIG. 1 taken along line 3—3.

In the embodiment shown in FIG. 1, the frame 10 generally comprises a vertical section 12 and a horizontal section 14. The frame 10 is comprised of a single unitary structure made of a molded thermoplastic material. Thus, the horizontal section 14 is fixedly connected to the vertical section 12. Referring also to FIGS. 2 and 3, it can be seen that both the vertical and horizontal sections of the frame 10 are comprised of a dual wall construction. The dual wall construction is generally provided due to the method used to manufacture the frame 10 such as blow molding, rotational molding, twin-sheet thermoforming, etc. These processes allow dual wall construction to be formed with hollow areas between the walls. The two walls come together at various locations, such as the perimeter 11 of the frame 10 and various selected apertures 30, 24, 54, 38, 48 to join the two walls together and add rigidity to the frame 10.

The vertical section 12 is generally intended to be supported on or against an operator's back. The vertical section 12 has a first side 16 formed by a first wall 17 and a second side 18 formed by a second wall 19. In the embodiment shown, the sides 16 and 18 are slightly curved to accommodate the curvature of an operator's back. A back cushion (not shown) is connected to the first side 16 to make the back pack more comfortable. In the embodiment shown, the first side 16 has holes 26 for fasteners (not shown) to pass into the interior 32 of the vertical section 12. The second side 18 has protrusions 28 aligned opposite the holes 26 to provide adequate space between the two walls 17 and 19 for the fasteners (not shown) to be located and be properly fastened. The vertical section 12 has a top section 20 which includes two apertures 22 through the vertical section 12 intended to be used in attaching the tops of shoulder straps 37 (only one of which is shown for the sake of clarity) thereto. The top also has a third aperture 24 adapted to be used as a hole for a user's hand such that the top 20 can function as a carry handle for the back pack. Other apertures 30 are also provided to add rigidity to the top 20.

In the embodiment shown, the second side 18 also has holes 34 therethrough at mounting areas 36. The holes 34 and the mounting areas 36 are used to connect a blower unit (not shown) to the vertical section 12. Located at opposite sides of the base of the vertical section 12 are shoulder strap mounting apertures 38 and waist strap mounting apertures 40. The base shoulder strap mounting apertures 38 are intended to have the bottoms of the shoulder straps 37 connected thereat. The waist strap mounting apertures 40 are intended to have waist straps (not shown) connected thereat such that the back pack can be st rapped to the waist and shoulders of an operator.

Figure 5:
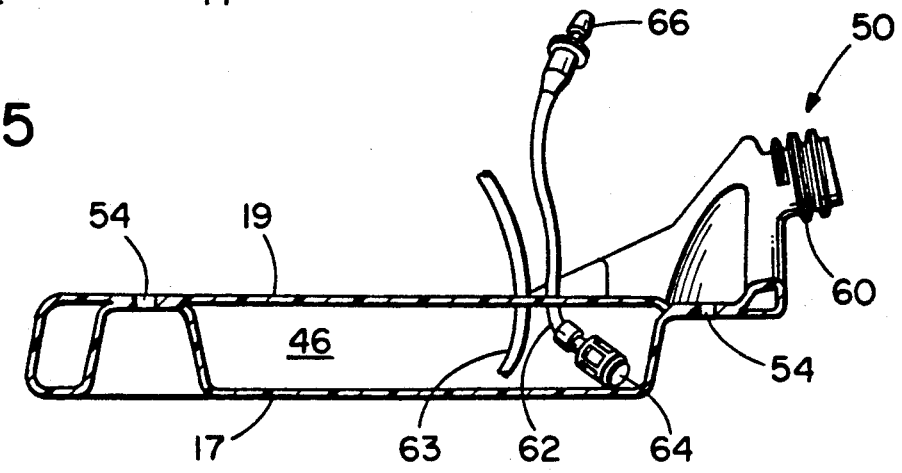
FIG. 5 is a cross-sectional view of a frame shown in FIG. 4 taken along line 5—5.
Figure 4:
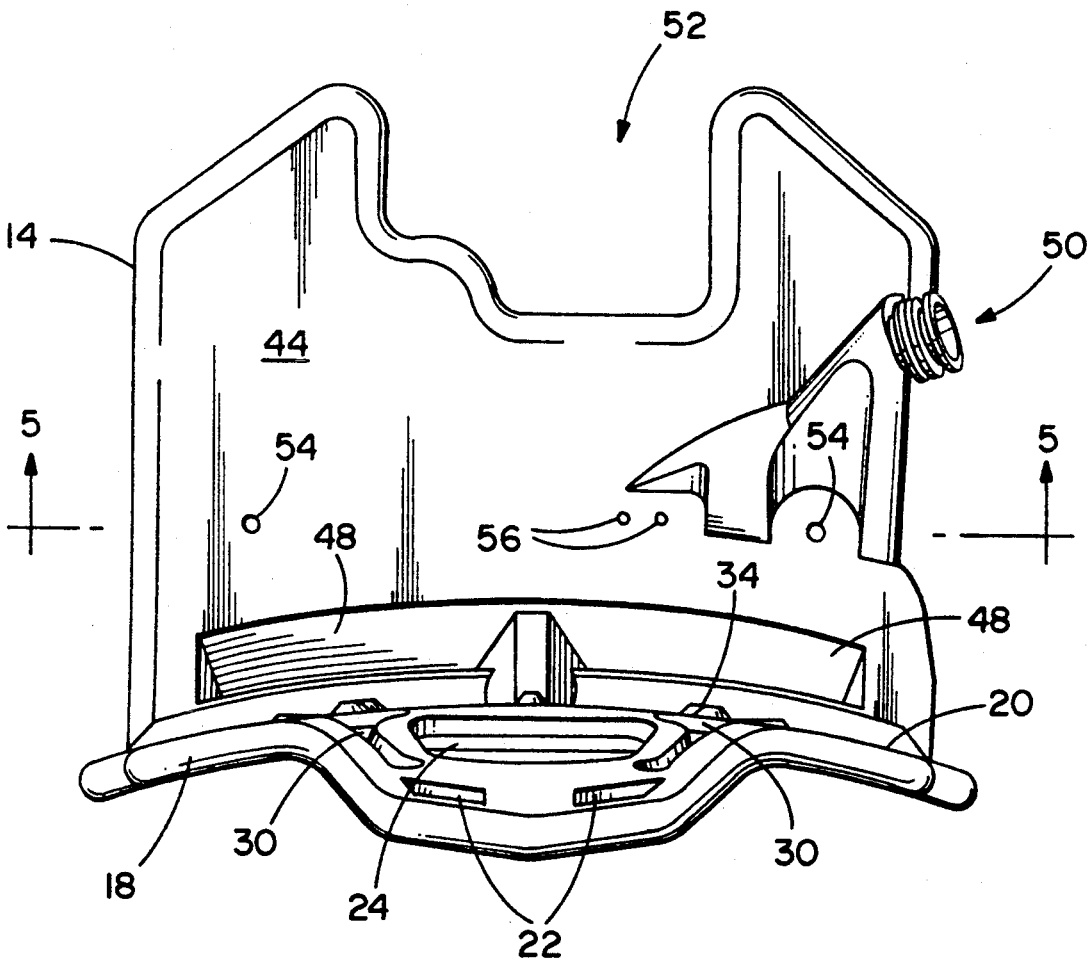
FIG. 4 is a plan top view of the frame shown in FIG. 1.

Referring also to FIGS. 4 and 5, the horizontal section 14, in the embodiment shown, extends substantially perpendicularly from the vertical section 12. The horizontal section 14, similar to the vertical section 12, has a dual wall construction with the first wall 17 forming the underside 42 and the second wall 19 forming the topside 44. A space 46 is established between the topside 44 and underside 42. The horizontal section 14 has two apertures 48 therethrough to allow air to pass through the frame 10. However, the air apertures 48 need not be provided. The horizontal section 14, in the embodiment shown, includes a nozzle section 50, a recessed area 52, mounting holes 54 and fluid transport holes 56. The nozzle section 50 includes an aperture 58 and threads 60. The threads 60 are adapted to allow a nozzle cap (not shown) to be removably connected to the nozzle section 50. The nozzle section 50 with its removable nozzle cap (not shown) are provided such that a fluid, such as gasoline, can be inserted into the space 46 in the horizontal section 14. The cap (not shown) allows access through the aperture 58 to the space 46 and prevents inadvertent spilling of the fluid out of the aperture 58.

The recessed area 52, in the embodiment shown, is generally provided to accommodate a portion of the blower unit (not shown). However, the recessed area 52 need not be provided. The mounting holes 54 are located at two structurally reinforced areas where the two walls 17 and 19 come together. Suitable fasteners (not shown) can be positioned through the holes 54 to mount the base of the blower unit (not shown) to the horizontal section 14. However, any suitable type of means for fastening the blower unit to the frame 10 can be provided. The fluid transport holes 56, in the embodiment shown, are generally adapted to allow passage of conduit tubes 62 and 63 through the wall 19 and into the interior space 46. In the embodiment shown, the tubes 62 and 63 are comprised of a suitable resilient and flexible material that passes through the holes 56 with their outer perimeter making a sealing engagement with the wall 19 at the holes 56. The tubes 62 and 63 are generally merely compressively pressed through the holes 56. In an alternate embodiment of the invention additional or alternative means to seal the tubes 62 and 63 at the holes 5 could be provided.

The first tube 62, in the embodiment shown, is generally intended to transport fuel from the space 46 to the blower unit (not shown). The second tube 63 is generally intended to return unused fuel from the blower unit to the supply space 46. However, the second tube 63 need not be provided. In the embodiment shown, attached to the end of the first tube 62, inside the space 46, is a fuel filter 64. The fuel filter is suitably sized and shaped to be passed through the nozzle aperture 58 and into the space 46. The connection of the fuel filter 64 to the first tube merely comprises inserting a portion of the filter 64 into the tube 62 which results in a friction connection between the two. However, in an alternate embodiment of the invention, the fuel filter 64 need not be provided or, may be provided in the blower unit. In the embodiment shown, located at the opposite end of the first tube 62 is a connector 66. The connector 66 has a portion that is inserted into the tube 62 and makes a friction connection therewith. The other end of the connector 66 is adapted to be removably connected to the fuel supply system of the blower unit. The fuel supply system of the blower unit is adapted to use vacuum to suck fuel from the space 46, through the filter 64 and tube 62, into the blower unit for combustion.

One of the principal advantages of the present invention is the fact that a supply of fluid can be stored in the frame itself. Unlike back packs in the prior art that had external storage containers connected thereto, the present invention forms its storage area integrally with its frame. This obviously reduces the cost of the back pack both in cost of materials and manufacturing time. Although the present invention has been described with reference to use in supplying fuel to a gasoline operated blower, it can be used with any suitable type of fuel operated machine or with any type of tool that delivers a fluid to an area such as a spraying device. When used with a device such as a blower, it can allow longer operation of the blower, by supplying an increased fuel storage area, without having to redesign the blower or a blower's integral fuel tank.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A back pack for use in carrying a machine having an internal combustion engine, the back pack having a one-piece frame and straps for removably supporting the back pack and machine on an operator, the one-piece frame comprising:

a first vertical section adapted to be positioned against a back of an operator; and a second horizontal section adapted to have the machine mounted thereon, the second section extending generally perpendicularly from the first section, being unitarily formed with the first section, having an integral storage area therein for supplying fuel to the engine and, having a dual wall structure with a space formed between the walls that defines the fuel storage area, wherein portions of the walls come together at selected locations of the second section and, the second section has holes through the walls at some of the selected locations for fasteners to mount the machine to the second section.

2. A back pack as in claim 1 wherein the frame is comprised of a molded thermoplastic material.

3. A back pack as in claim 1 wherein the second section has a nozzle for filling the fuel storage area with fuel.

4. A back pack as in claim 1 wherein the back pack further comprises a fuel supply tube extending from the storage area adapted to be connected to the engine.

5. A back pack as in claim 1 wherein the back pack has a fuel filter located inside the second section of the frame.

6. A back pack comprising:

a one-piece back pack frame for supporting a blower unit on the back of an operator, the frame being comprised of a molded dual wall structure with a vertical section adapted to be supported against the back of an operator and a horizontal section adapted to support the blower thereon, the frame forming an integral internal fuel storage tank within its dual wall structure at the horizontal section, the storage tank being located throughout substantially the entire horizontal section; and means for supplying fuel from the tank to the blower.

7. A back pack as in claim 6 wherein the frame has a fuel nozzle for filling the tank with fuel.

8. A back pack as in claim 6 wherein the means for supplying fuel includes a fuel supply tube extending through a hole in one of the walls of the structure.

9. A back pack as in claim 6 wherein the means for supplying fuel includes a fuel filter located inside the horizontal section.

10. A back pack as in claim 6 further comprising means for returning fuel from the blower to the tank.

11. A back pack frame comprising:

a vertical section adapted to be supported on a back of an operator;

a horizontal section adapted to at least partially support a machine having an internal combustion engine thereon; and means for storing a combustible fuel inside the frame along substantially the entire horizontal section, the means for storing comprising the frame having a molded dual wall construction with a space between portions of the walls such that the space between the walls can function as a fuel tank to store fuel for use with the engine being carried on the frame.

12. A frame as in claim 11 wherein the frame further comprises a nozzle for filling the space with fuel.

13. A frame as in claim 11 wherein the frame has multiple separated spaces between the walls.

14. A frame as in claim 11 wherein the frame has holes that pass through one wall and holes that pass through both walls.

15. A frame as in claim 11 further comprising means for connecting straps to the frame.

* * * * *